US009618952B2

(12) United States Patent
Kochkin et al.

(10) Patent No.: US 9,618,952 B2
(45) Date of Patent: Apr. 11, 2017

(54) CURRENT GENERATOR CIRCUIT AND METHOD OF CALIBRATION THEREOF

(71) Applicants: Ivan Victorovich Kochkin, Zelenograd (RU); Sergey Sergeevich Ryabchenkov, Zelenograd (RU)

(72) Inventors: Ivan Victorovich Kochkin, Zelenograd (RU); Sergey Sergeevich Ryabchenkov, Zelenograd (RU)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 14/781,318

(22) PCT Filed: Apr. 1, 2013

(86) PCT No.: PCT/RU2013/000275
§ 371 (c)(1),
(2) Date: Sep. 30, 2015

(87) PCT Pub. No.: WO2014/163521
PCT Pub. Date: Oct. 9, 2014

(65) Prior Publication Data

US 2016/0041571 A1 Feb. 11, 2016

(51) Int. Cl.
*G05F 1/567* (2006.01)
*G05F 3/30* (2006.01)
*G05F 1/46* (2006.01)

(52) U.S. Cl.
CPC ..... *G05F 1/567* (2013.01); *G05F 1/468* (2013.01); *G05F 3/30* (2013.01)

(58) Field of Classification Search
CPC ..... G05F 1/567
USPC ..... 323/312, 315, 907
See application file for complete search history.

(56) References Cited

U.S. PATENT DOCUMENTS 4,769,589 A * 9/1988 Rosenthal ..... G05F 3/245 323/313
6,750,641 B1 6/2004 Ivanov et al.
7,272,523 B1 9/2007 John et al.
7,411,380 B2 * 8/2008 Chang ..... G05F 3/30 323/314
7,703,051 B2 4/2010 Grudin et al.
8,760,143 B2 * 6/2014 Satoh ..... G05F 3/30 323/315
8,766,611 B2 * 7/2014 Hu ..... G05F 1/561 323/281

(Continued)

OTHER PUBLICATIONS

International Search Report and Written Opinion correlating to PCT/RU2013/000275 issued on Jan. 28, 2014.

(Continued)

*Primary Examiner* — Jeffrey Sterrett
(74) *Attorney, Agent, or Firm* — Charlene R. Jacobsen

(57) ABSTRACT

A current generator circuit includes at least one current generation component arranged to generate an output current of the current generator circuit, at least one absolute current calibration component arranged to enable calibration of an absolute current value of the output current, and at least one temperature coefficient calibration component arranged to enable calibration of a temperature coefficient characteristic of the output current. The at least one temperature coefficient calibration component is further arranged to be in a passive state at a reference temperature.

19 Claims, 5 Drawing Sheets

(56) References Cited

U.S. PATENT DOCUMENTS

| | | | | |
|---|---|---|---|---|
| 2007/0296392 | A1 | 12/2007 | Chen et al. | |
| 2008/0036524 | A1 | 2/2008 | Oberhuber | |
| 2010/0301832 | A1 | 12/2010 | Katyal et al. | |
| 2015/0054487 | A1* | 2/2015 | Kochkin | G05F 3/30 323/314 |
| 2015/0370280 | A1* | 12/2015 | Ryabchenkov | G05F 3/26 323/315 |
| 2016/0041571 | A1* | 2/2016 | Kochkin | G05F 3/30 323/312 |

OTHER PUBLICATIONS

Charalambos M Andreoli et al: A Novel Wide-Temperature-Range, 3.9 ppm/°CMOS Bandgap Reference Circuit, IEEE Journal of Solid-State Circuits, IEEE Service Center, Piscataway, NJ, USA, vol. 47, No. 2.

* cited by examiner

CURRENT GENERATOR CIRCUIT AND METHOD OF CALIBRATION THEREOF

FIELD OF THE INVENTION

This invention relates to a current generator circuit, and in particular to an integrated current generator circuit and a method for calibrating such a current generator circuit.

BACKGROUND OF THE INVENTION

Integrated circuit, IC, applications often require a reference current. Typically, such reference currents are provided by integrated reference currents circuits. With the continued increase in device densities within integrated circuits, the required precision and stability of such reference currents also continues to increase. Furthermore, such reference currents are required to be temperature independent.

FIG. 1 illustrates a circuit diagram of an example of a conventional integrated current generator circuit 100 for generating a reference current $I_{OUT}$ 105. $I_{OUT}$ 105=$I_{TI}$ 110 by virtue of a current mirror arrangement comprising MOS (Metal Oxide Semiconductor) devices M1 120, M2 122 and M3 124. BJT (Bipolar Junction transistor) devices Q1 130 and Q2 132 are configured in an asymmetrical current mirror arrangement, with resistance R2 142 providing a voltage difference between their respective base terminals. The base-emitter voltage of Q1 130 ($V_{beQ1}$) is applied across resistance R1 140, thus the current through R1 140 is equal to $V_{beQ1}$/R1. Assuming that the base current of Q1 130 is negligible (i.e. much less than $I_{TI}$ 110), the current through R2 142 is equal to the current through R1 140 due to feedback provided by MOS device M4 126. So, the voltage applied to the base of Q2 132 is (R2+R1)*$V_{beQ1}$/R1. The voltage at the emitter of Q2 132 ($V_{eQ2}$) is lower than at the base of Q2 132 by $V_{beQ2}$. Accordingly, $V_{eQ2}$=((R2+R1)*$V_{beQ1}$/R1)−$V_{beQ2}$. Devices Q1 130, Q2 132, M1 120 and M2 122 are sized in such a way as to provide a Q2 emitter current density that is N times lower than a Q1 emitter current density. Accordingly:

$$V_{beQ1}-V_{beQ2}=VT*\ln(N) \quad \text{[Equation 1]}$$

where VT is a thermal potential k*T/q, and "k" is a Boltzmann's constant, "q" is the charge of an electron, and "T" is an absolute temperature, in degrees of Kelvin.

The voltage at the emitter of Q2 132 may be written as following:

$$V_{eQ2} = \frac{R1+R2}{R1}\cdot V_{beQ1} - V_{beQ2} = \left(1+\frac{R2}{R1}\right)\cdot V_{beQ1} - V_{beQ2} = \frac{R2}{R1}V_{beQ1} + (V_{beQ1} - V_{beQ2}) \quad \text{[Equation 2]}$$

Substituting Equation 1 into Equation 2 gives:

$$V_{eQ2} = \frac{R2}{R1}V_{beQ1} + \frac{k\cdot T}{q}\cdot\ln(N) \quad \text{[Equation 3]}$$

According to Equation 3, the voltage at the emitter of Q2 is a sum of two terms. The first term is proportional to VbeQ1 voltage, having a negative temperature coefficient. The second term is proportional to absolute temperature T.

When these two terms are taken in the right proportion, determined by the R2/R1 ratio, their sum may be almost independent of temperature.

The voltage at the emitter of Q2 132 is applied to the (R3+Rabs<1>+Rabs<0>) calibration resistance 144. The temperature independent current $I_{TI}$ 110 is equal to:

$$I_{TI} = \frac{V_{eQ2}}{R3+Rabs\langle 1\rangle + Rabs\langle 0\rangle} = \frac{1}{R3+Rabs\langle 1\rangle + Rabs\langle 0\rangle}\cdot\left(\frac{R2}{R1}\cdot V_{eQ1} + \frac{k\cdot T}{q}\cdot\ln(N)\right) \quad \text{[Equation 4]}$$

By adjusting the ratio between R2 142 and R1 140, the temperature coefficient of $I_{TI}$ 110 may be adjusted. By adjusting the resistance of the calibration circuit 144, the absolute value of $I_{TI}$ 110 may be adjusted, or 'trimmed' to achieve a desired reference current $I_{OUT}$ 105.

FIG. 2 illustrates an example of $I_{OUT}$ 105 versus temperature dependence for different states of calibration achieved through conventional adjusting of the ratio between R2 142 and R1 140 for the conventional integrated current generator circuit 100 of FIG. 1.

As apparent from Equation 4 above, when the temperature coefficient for such a conventional integrated current generator circuit 100 is trimmed (by adjusting the ratio between R2 142 and R1 140), the absolute value of $I_{TI}$ 110, and thus of $I_{OUT}$ 105, is changed as well. To trim both the temperature coefficient and the absolute value, the following test procedure should be implemented:

i) Measure $I_{OUT}$ value at a first temperature (T1) from a range; store the measured value $I_{OUT}$ (T1) either in external memory (tester), or in internal memory (non-volatile die memory, fuses, etc.).

ii) Measure $I_{OUT}$ value at a second temperature (T2) from a range; calculate the temperature coefficient, implement TC calibration based on temperature coefficient calculated.

iii) Trim the absolute value of $I_{OUT}$; assuming the TC is minimized, the absolute value calibration may be implemented at the same temperature T2.

A problem with such a calibration procedure is the need to store the value $I_{OUT}$ (T1). If this value is stored in external memory (e.g. within test equipment), all of the IC devices in a lot have to be serialized (numbered and tracked). If this value is stored in internal memory (i.e. on-die), it requires additional die size.

Furthermore, using a look-ahead procedure (a simple search through all trim bit combinations to find the best one) for temperature coefficient calibration is prohibitively complicated for such a calibration procedure. When a look-ahead procedure is implemented at a given, single temperature, it is quite simple and straightforward. The simple search through all trim bit combinations to find and apply a specific combination that achieves the target $I_{OUT}$ may be easily and efficiently implemented. However, when more than one (i.e. two in the above procedure) test insertion at multiple (i.e. two in the above procedure) different temperatures are required, the look-ahead procedure becomes prohibitively complicated because one needs to store not just a single number (e.g. the result of the $I_{OUT}$ measurement at T1), but all data measured (i.e. two arrays of numbers corresponding to both T1 and T2 in the above procedure), and then to search through all trim bit combinations to find and apply a specific combination that achieves the target $I_{OUT}$ taking into account all measured data. Performing such a look-ahead procedure for all IC devices in a lot during mass production is prohibitively complicated.

Accordingly, blind calibration using typical step value from a calibration table is typically used instead. For example, assuming $I_{OUT}$ is measured at T1 and the result is stored. $I_{OUT}$ is then re-measured at T2. The Temperature coefficient may then be calculated as $[I_{OUT}(T1)-I_{OUT}(T2)]/[T1-T2]$. After that, calibration may be performed using some assumption about best trim bit combination. However, being resistive-dependent, the trim step value is not absolutely precise; it depends on process variation as well. Accordingly, trim errors are possible when using blind calibration. The result of blind calibration may be validated only after the calibration is performed, with the calibrated circuit being re-measured again at T1 & T2. However, such validation is not practical, because it is too expensive to perform multiple thermal cycling during mass production. As such, the result of blind calibration may not be as accurate and consistent with process variation as a look-ahead procedure.

SUMMARY OF THE INVENTION

The present invention provides a current generator circuit, and integrated circuit device comprising such a current generator circuit and a method for calibrating such a current generator circuit as described in the accompanying claims.

Specific embodiments of the invention are set forth in the dependent claims.

These and other aspects of the invention will be apparent from and elucidated with reference to the embodiments described hereinafter.

BRIEF DESCRIPTION OF THE DRAWINGS

Further details, aspects and embodiments of the invention will be described, by way of example only, with reference to the drawings. In the drawings, like reference numbers are used to identify like or functionally similar elements. Elements in the figures are illustrated for simplicity and clarity and have not necessarily been drawn to scale.

DETAILED DESCRIPTION OF THE PREFERRED EMBODIMENTS

Figure 1:
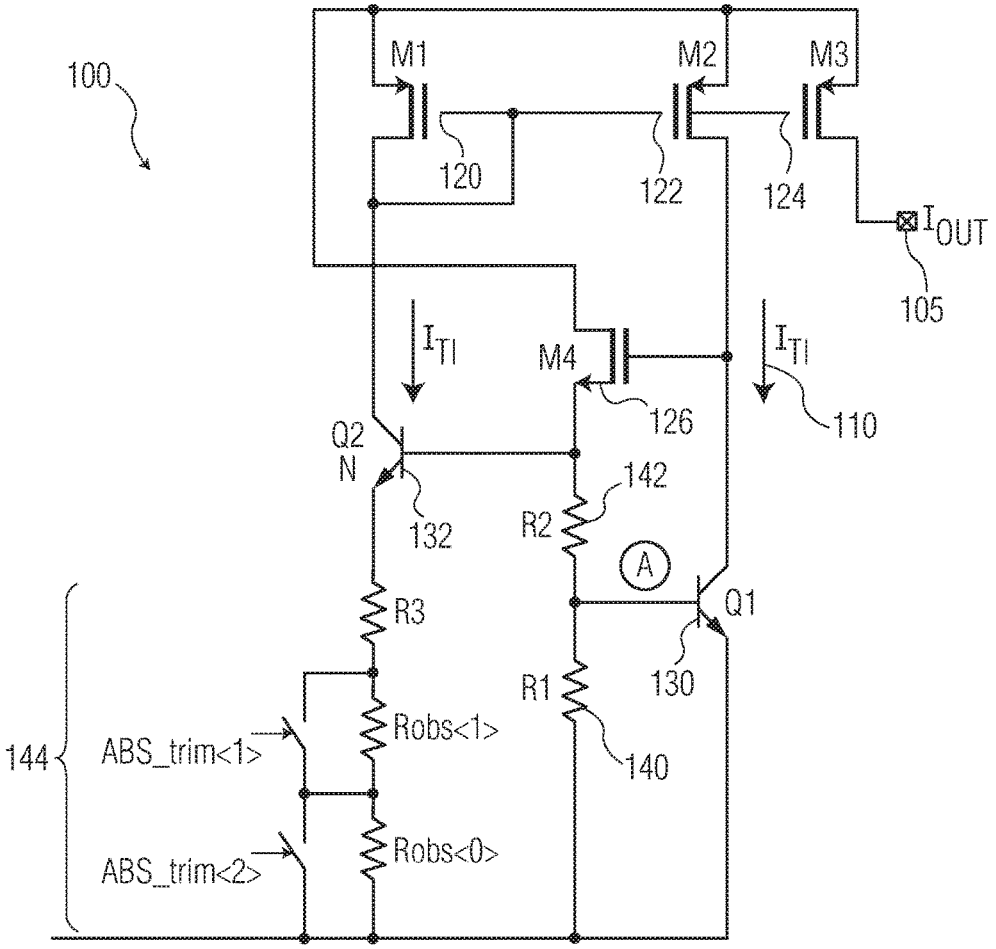
FIG. 1 PRIOR ART
FIG. 1 illustrates a circuit diagram of an example of a conventional integrated current generator circuit.
Figure 2:
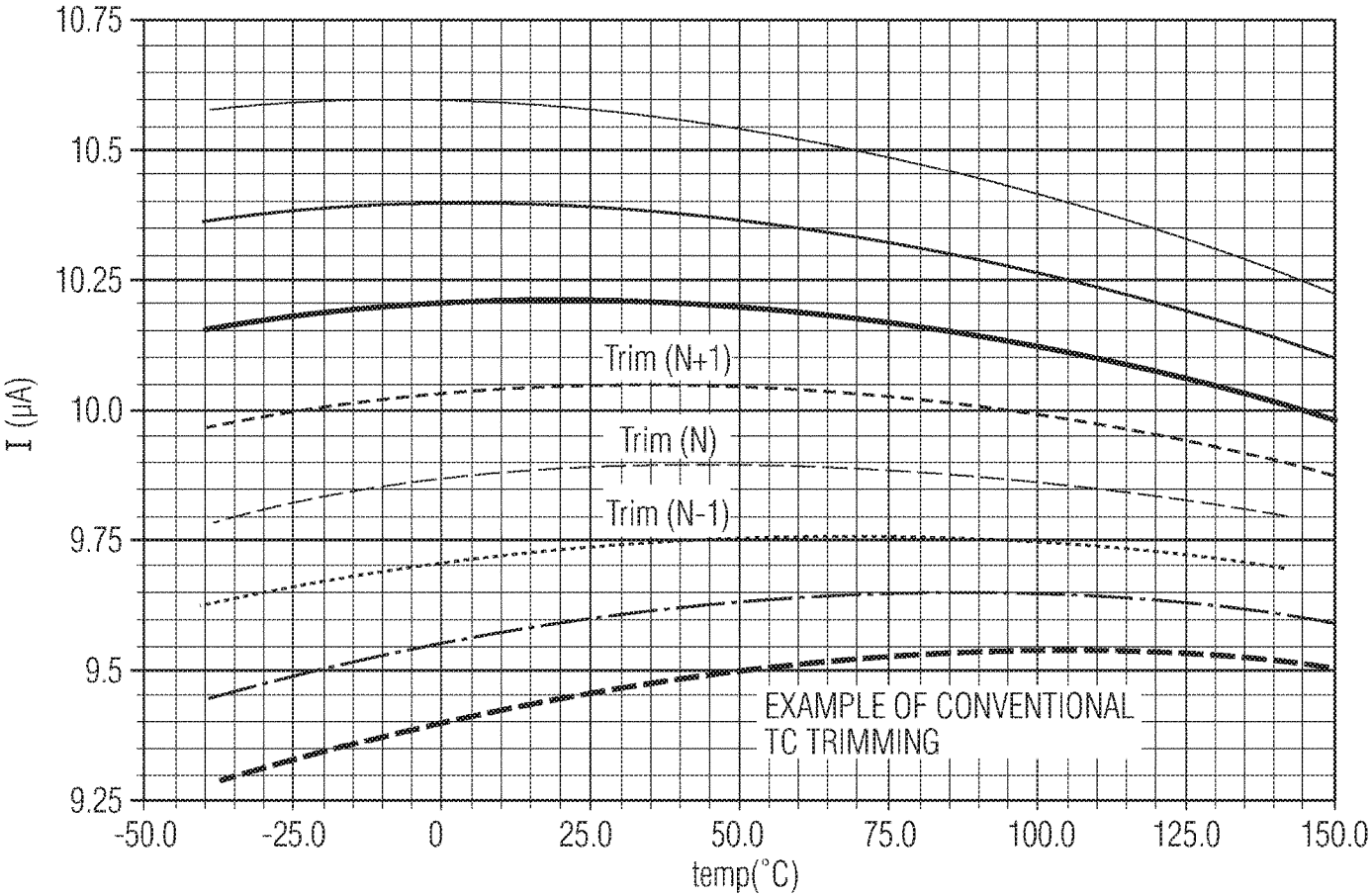
FIG. 2 PRIOR ART
FIG. 2 illustrates an example of output current versus temperature dependence for different calibration bit combinations for the conventional integrated current generator circuit of FIG. 1.

The present invention will now be described with reference to the accompanying drawings, in which an example of the present invention is illustrated. However, it will be appreciated that the present invention is not limited to the specific example herein described with reference to the accompanying drawings, and alternative embodiments of the present invention may depart from the specific example herein described in various aspects as will become apparent. Furthermore, because the illustrated embodiments of the present invention may for the most part, be implemented using electronic components and circuits known to those skilled in the art, details will not be explained in any greater extent than that considered necessary as illustrated below, for the understanding and appreciation of the underlying concepts of the present invention and in order not to obfuscate or distract from the teachings of the present invention.

According to an example of one aspect of the present invention, there is provided a current generator circuit comprising at least one current generation component arranged to generate an output current of the current generator circuit, at least one absolute current calibration component arranged to enable calibration of an absolute current value of the output current, and at least one temperature coefficient calibration component arranged to enable calibration of a temperature coefficient characteristic of the output current. The at least one temperature coefficient calibration component is further arranged to be in a passive state at a reference temperature, for example such that the output current of the current generator circuit comprises an unaltered absolute current value at the reference temperature.

In some examples, the at least one current generation component may comprise at least a first current mirror stage, the at least first current mirror stage comprising a first transistor device and a second transistor device configured in an asymmetric current mirror arrangement whereby the first transistor device is configured as a current-to-voltage converter and the second transistor device is configured as a voltage-to-current converter, and at least a first resistance, R1, is operably coupled between base and emitter terminals of the first transistor device, and at least one further resistance, R2, is operably coupled between the base terminal of the first transistor device and the base terminal of the second transistor device.

In some examples, the at least one temperature coefficient calibration component may be arranged to introduce a temperature dependent current, into a common node between the at least first and at least one further resistances R1, R2.

In some examples, the at least one temperature coefficient calibration component may be arranged such that the temperature dependent current is equal to zero at the reference temperature.

In some examples, the at least one temperature coefficient calibration component may comprise at least one configurable resistance component operably coupled between the common node between the at least first and at least one further resistances R1, R2 and a further node within the at least one temperature coefficient calibration component, and the at least one temperature coefficient calibration component is arranged to generate a temperature dependent voltage at the further node therein.

In some examples, the at least one temperature coefficient calibration component may be arranged to generate a temperature dependent voltage at the further node therein equal to the voltage at the common node between the at least first and at least one further resistances R1, R2 at the reference temperature.

In some examples, the at least one temperature coefficient calibration component may comprise a temperature coefficient transistor device, a base terminal of which is operably coupled to the further node of the at least one temperature coefficient calibration component. The temperature coefficient transistor device of the at least one temperature coefficient calibration component and the first transistor device of the at least first current mirror stage of the at least one current generation component may be arranged to have the same emitter current density at the reference temperature.

In some examples, the at least one temperature coefficient calibration component may comprise a current mirror stage, the current mirror stage comprising a first current mirror stage transistor device configured as a current-to-voltage converter and arranged to convert a current flowing through the at least one further resistance R2 of the at least one current generation component into a voltage signal, and a second current mirror stage transistor device configured as a voltage-to-current converter and arranged to convert the voltage signal generated by the first current mirror stage transistor device into a collector current for the temperature coefficient transistor device.

In some examples:

the first transistor device of the at least first current mirror stage of the at least one current generation component;

the temperature coefficient transistor device of the at least one temperature coefficient calibration component; and the first and second current mirror stage transistor devices of the at least one temperature coefficient calibration component may be sized such that the first transistor device of the at least first current mirror stage of the at least one current generation component and the temperature coefficient transistor device of the at least one temperature coefficient calibration component comprise the same emitter current density at the reference temperature.

In some examples, the at least one temperature coefficient calibration component may further comprise at least one further transistor device operably coupled to the base terminal of the temperature coefficient transistor device, and arranged to provide drive to the base terminal of the temperature coefficient transistor device such that the collector current of the temperature coefficient transistor device is equal to the current supplied thereto by the second current mirror stage transistor device.

In some examples, the at least one temperature coefficient calibration component may further comprise at least one resistance operably coupled between a base terminal of the temperature coefficient transistor device and a ground plane.

In some examples, reverse feedback may be provided between the collector and base terminals of the first transistor device of the at least first current mirror stage of the at least one current generation component by way of a feedback transistor device operably coupled between a supply rail and the base terminal of the first transistor device of the at least first current mirror stage of the at least one current generation component, and responsive to the voltage at the collector terminal of the first transistor device of the at least first current mirror stage of the at least one current generation component.

In some examples, a current flow through the second transistor device of the at least first current mirror stage of the at least one current generation component may comprise a reference current on which the output current of the current generator circuit is at least partially based.

In some examples, the at least one current generation component may further comprise at least one further current mirror stage, the at least one further current mirror stage comprising a third transistor device configured as a current-to-voltage converter and arranged to convert the current flowing through the second transistor device of the at least first current mirror stage of the at least one current generation component into a voltage signal.

In some examples, the at least one further current mirror stage may comprise a fourth transistor device configured as a voltage-to-current converter and arranged to convert the voltage signal generated by the third transistor device into a collector current for the first transistor device of the at least first current mirror stage of the at least one current generation component.

In some examples, the at least one further current mirror stage may comprise a fifth transistor device configured as a voltage-to-current converter and arranged to convert the voltage signal generated by the third transistor device into the output current of the current generator circuit.

In some examples, the at least one absolute current calibration component may be operably coupled to an emitter terminal of the second transistor device of the at least first current mirror stage of the at least one current generation component, and arranged to enable a voltage at the emitter terminal of the second transistor device of the at least first current mirror stage to be calibrated.

According to an example of a second aspect of the present invention, there is provided an integrated circuit device comprising at least one current generator circuit according to the first aspect of the invention.

According to an example of a third aspect of the present invention, there is provided a method of calibrating a current generator circuit of the first aspect of the present invention. The method comprises subjecting the current generator circuit to the reference temperature, performing calibration of an absolute current value of the output current of the current generator circuit whilst the current generator circuit is subjected to the reference temperature, subjecting the current generator circuit to a second temperature, and performing calibration of a temperature coefficient characteristic of the output current of the current generator circuit whilst the current generator circuit is subjected to the second temperature.

Figure 3:
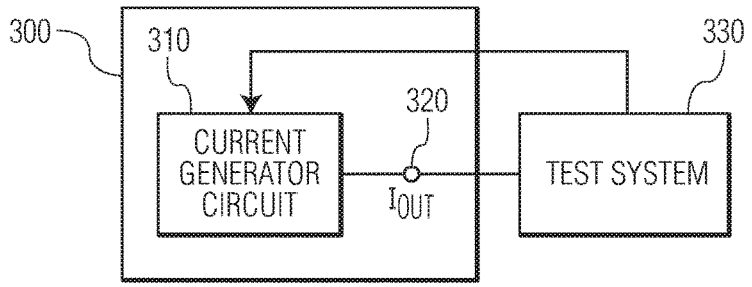
FIG. 3 illustrates a simplified block diagram of an example of an integrated circuit device comprising a current generator circuit.

Referring first to FIG. 3, there is illustrated a simplified block diagram of an example of an integrated circuit (IC) device 300 comprising a current generator circuit 310. The current generator circuit 310 is arranged to generate an output current $I_{OUT}$ 320, for example such as may be used within the IC device 300 as a reference current. As such, the current generator circuit 310 may be required to generate the output current $I_{OUT}$ 320 comprising a sufficiently high precision and stability, and significantly for the output current $I_{OUT}$ 320 to be substantially temperature independent. In order to achieve a high level of precision across all such IC devices, calibration of the current generator circuit 310 is required in order to compensate for process corner variations etc. that can affect performance and operational tolerances of the various components within the IC device 300. Accordingly, following fabrication of the IC device 300, a test system 330 may be used to perform such calibration of the current generator circuit 310, as described in greater detail below.

Figure 4:
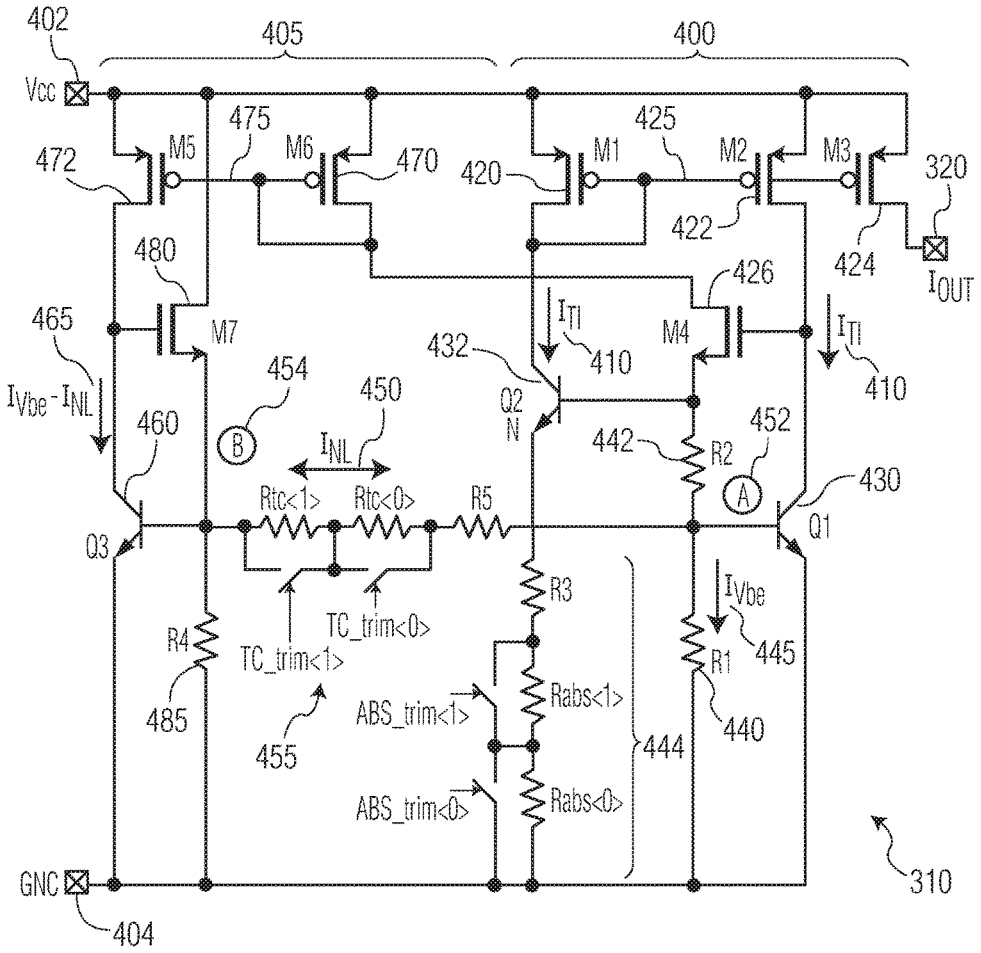
FIG. 4 illustrates a simplified circuit diagram of an example of the current generation circuit of FIG. 3

Referring now to FIG. 4, there is illustrated a simplified circuit diagram of an example of the integrated current generation circuit 310 of FIG. 3. In the example illustrated in FIG. 4, the current generation circuit 310 comprises a current generation component, indicated generally at 400, arranged to generate the output current $I_{OUT}$ 320. The current generator circuit 310 further comprises an absolute current calibration component, illustrated generally at 444, arranged to enable calibration of an absolute current value of the output current, and a temperature coefficient calibration component, illustrated generally at 405, arranged to enable calibration of a temperature coefficient characteristic of the output current $I_{OUT}$ 320.

The current generation component 400 comprises a first current mirror stage comprising a first transistor device Q1 430 and a second transistor device Q2 432, which in the illustrated example comprise npn bipolar junction transistors (BJTs). The first and second transistor devices 430, 432 are configured in an asymmetric current mirror arrangement whereby the first transistor device Q1 430 is configured as a current-to-voltage converter and the second transistor device Q2 432 is configured as a voltage-to-current converter. A first resistance R1 440 is operably coupled between base and emitter terminals of the first transistor device Q1 430. In the illustrated example, the emitter terminal of the first transistor device Q1 430 is operably coupled to a ground plane 404, and the first resistance R1 440 is operably coupled between the base terminal of the first transistor device Q1 430 and the ground plane 404. A further resistance R2 442 is operably coupled between the base terminal of the first transistor device Q1 430 and the base terminal of the second transistor device Q2 432.

In the illustrated example, reverse feedback is provided between the collector and base terminals of the first transistor device Q1 430 of the first current mirror stage by way of a feedback transistor device 426 operably coupled between a supply rail VCC 402 and the base terminal of the first transistor device Q1 430, and responsive to the voltage at the collector terminal of the first transistor device Q1 430. In the example illustrated in FIG. 4, the feedback transistor device 426 comprises an n-channel MOS (Metal Oxide Semiconductor) device, a gate of which is operably coupled to the collector terminal of the first transistor device Q1 430, a source of which is operably coupled to the base terminal of the first transistor device Q1 430 via the resistance R2 442, and a drain of which is operably coupled to the supply rail VCC 402 (via transistor M6 470 as described in greater detail below).

A current flow $I_{TI}$ 410 through the second transistor device Q2 432 of the first current mirror stage of the current generation component 400 comprises a reference current on which the output current $I_{OUT}$ 320 of the current generator circuit is at least partially based. In the illustrated example, the current generation component 400 further comprises a further current mirror stage arranged to use the current flow $I_{TI}$ 410 as a reference current, and to output the output current $I_{OUT}$ 320. The further current mirror stage comprises a third transistor device M1 420, which in the illustrated example comprises a p-channel MOS device, configured as a current-to-voltage converter and arranged to convert the current flow $I_{TI}$ 410 into a voltage signal, indicated generally at 425. As illustrated in FIG. 4, the further current mirror stage may comprise a fourth transistor device M2 422, which in the illustrated example comprises a p-channel MOS device, configured as a voltage-to-current converter and arranged to convert the voltage signal 425 generated by the third transistor device M1 420 into a collector current for the first transistor device Q1 430 of the first current mirror stage the current generation component 400 into a voltage signal. The further current mirror stage comprises a fifth transistor device M3 424 configured as a voltage-to-current converter and arranged to convert the voltage signal 425 generated by the third transistor device M1 420 into the output current $I_{OUT}$ 320 of the current generator circuit 310.

In this manner, the output current $I_{OUT}$ 320 is equal to the reference current $I_{TI}$ 410 by virtue of the current mirror arrangement comprising transistor devices M1 420, M2 422 and M3 424. Transistor devices Q1 430 and Q2 432 are configured in an asymmetrical current mirror arrangement, with resistance R2 442 providing a voltage difference between their respective base terminals. The base-emitter voltage of Q1 430 ($V_{beQ1}$) is applied across resistance R1 440, thus the current $I_{Vbe}$ 445 through R1 440 is equal to $V_{beQ1}$/R1. The voltage at the emitter of Q2 432 is applied to the absolute current value calibration circuit 444, which in the illustrated example comprises a configurable resistance component (made up of resistances R3, Rabs<1> and Rabs<0> and calibration switches (or fuses) ABS_trim<1> and ABS_trim<0>) operably coupled between the emitter terminal of the second transistor device Q2 432 and the ground plane 404. By adjusting the resistance of the absolute current calibration component 444, the absolute value of $I_{TI}$ 110 may be adjusted, or 'calibrated' to achieve a desired output current $I_{OUT}$ 320.

As previously mentioned, the temperature coefficient calibration component 405 is arranged to enable calibration of a temperature coefficient characteristic of the output current $I_{OUT}$ 320. Significantly, the temperature coefficient calibration component 405 is arranged to be in a passive state at a reference temperature, for example such that the output current $I_{OUT}$ 320 of the current generator circuit 320 comprises an unaltered absolute current value at the reference temperature.

Figure 5:
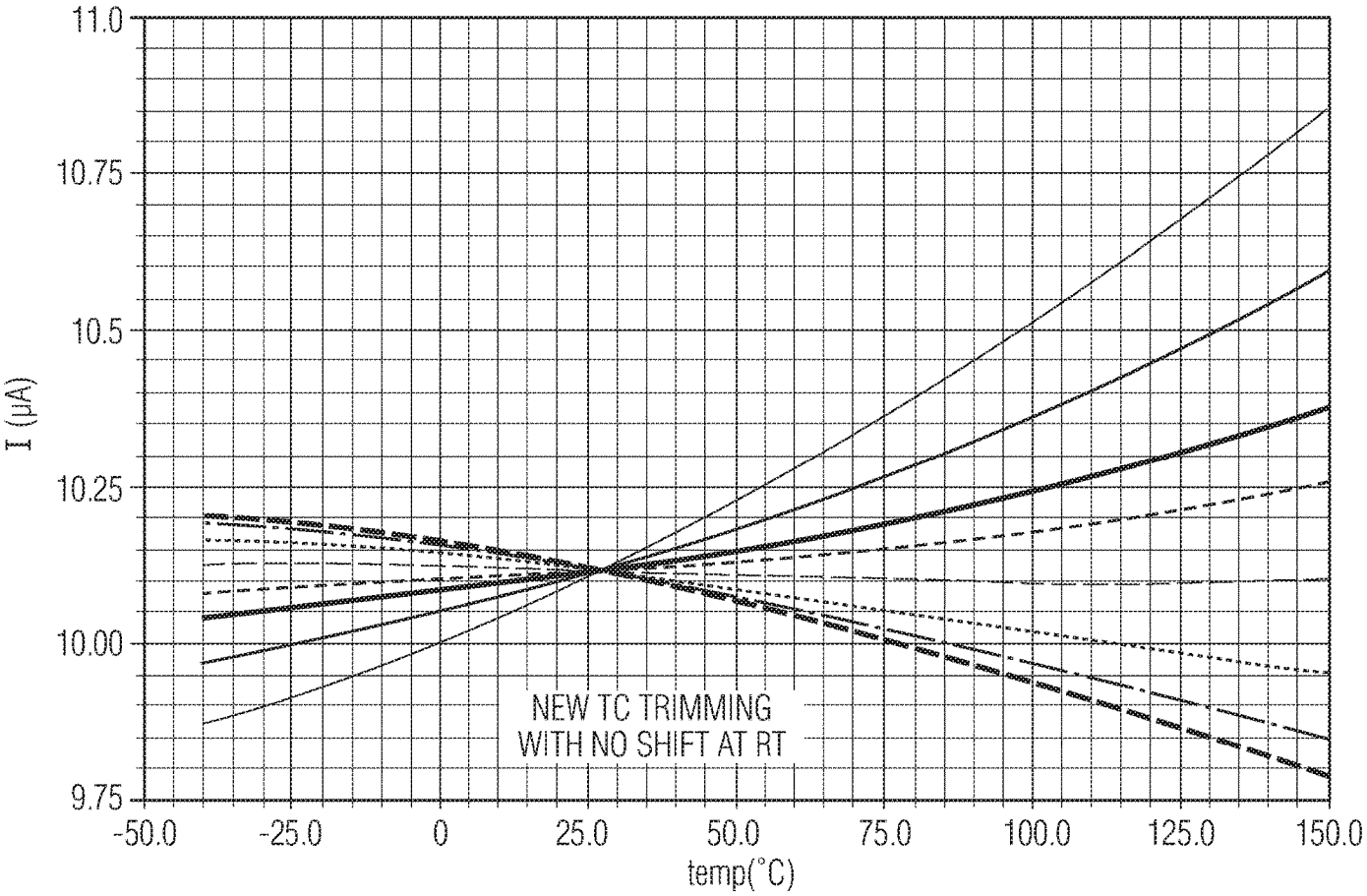
FIG. 5 illustrates a simplified example of the output current for the current generator of FIG. 4 versus temperature dependence for different temperature coefficient calibration bit combinations.

FIG. 5 illustrates a simplified example of the output current $I_{OUT}$ 320 for the current generator 310 versus temperature dependence for different calibration bit combinations for the temperature coefficient calibration component 405. As can be seen in FIG. 5, by arranging the temperature coefficient calibration component 405 to be in a passive state at a reference temperature (which in the example illustrated in FIG. 5 is around 27° C.) whereby the temperature coefficient calibration component 405 has substantially no effect on the absolute current value of the output current $I_{OUT}$ 320 at the reference temperature, the output current $I_{OUT}$ 320 comprises a consistent value (i.e. the absolute output current value) at the reference temperature, irrespective of how the coefficient calibration component 405 has been configured. Advantageously, this enables the absolute current value for the output current $I_{OUT}$ 320 to be accurately calibrated, by way of the absolute current calibration component 444, substantially independently of any temperature coefficient calibration. Furthermore, by providing a separate component for temperature coefficient calibration, having calibrated the absolute current value at the reference temperature, temperature coefficient calibration may subsequently be performed at a second temperature (at which the temperature coefficient calibration component 405 is not in a passive state), substantially independently of the absolute current value calibration.

Referring back to FIG. 4, the temperature coefficient calibration component 405 is arranged to introduce a temperature dependent current $I_{NL}$ 450 into the common point (A) 452 between resistances R1 440 and R2 442. In operation, the base-emitter voltage for the first transistor device Q1 430 is relatively stable with variations in the collector current of the first transistor device Q1 430, since $V_{be}=V_t*\ln(I_C/I_{sat})$. As a result, the current flow $I_{Vbe}$ 445 through resistance R1 440 is also relatively stable. Thus, when the temperature dependent current $I_{NL}$ 450 is introduced into the common point (A) 452, because the current flow $I_{Vbe}$ 445 through resistance R1 440 is held at a relatively stable value, the current flowing through resistance R2 442 is forced to change, which in turn causes a change in voltage across the resistance R2 442 and at the base terminal of the second transistor device Q2 435. This change in the voltage at the base terminal of the second transistor device Q2 435 changes the voltage at the emitter of the second transistor device Q2 435, which is used to generate the reference current $I_{TI}$ 410 upon which the output current $I_{OUT}$ 320 of the current generator circuit 310 is at least partially based. Thus, the introduction of such a current $I_{NL}$ 450 into the common point (A) 452 between resistances R1 440 and R2 442 enables a degree of manipulation of the output current $I_{OUT}$ 320 to be achieved.

In the illustrated example, the temperature coefficient calibration component 405 comprises a configurable resistance component (which in the illustrated example is made up of resistances R5, Rtc<1> and Rtc<0> and calibration switches (or fuses) TC_trim<1> and TC_trim<0>) illustrated generally at 455, operably coupled between the common node (A) 452 between resistances R1 440 and R2 442 and a further node (B) 454 within the temperature coefficient calibration component 405. In order to introduce the temperature dependent current $I_{NL}$ 450 into the common point (A) 452 between resistances R1 440 and R2 442, the temperature coefficient calibration component 405 is arranged to generate a temperature dependent voltage at the further node (B) 454.

The temperature coefficient calibration component comprises a temperature coefficient (TC) transistor device Q3 460, a base terminal of which is operably coupled to the further node (B) 454. In addition, an emitter terminal of the TC transistor device Q3 460 is operably coupled to the ground plane 404.

In the illustrated example, the temperature coefficient calibration component 405 further comprises a current mirror stage comprising a first current mirror stage transistor device M6 470 configured as a current-to-voltage converter and arranged to convert a current flowing through the resistance R2 442 of current generation component 400 into a voltage signal, indicated generally at 475. The current mirror stage of the temperature coefficient calibration component 405 further comprises a second current mirror stage transistor device M5 472 configured as a voltage-to-current converter and arranged to convert the voltage signal 475 generated by the first current mirror stage transistor device M6 470 into a collector current 465 for the TC transistor device Q3 460. As can be seen from FIG. 4, the current flowing through the resistance R2 442 is equal to the current $I_{Vbe}$ 445 flowing through R1 440 less the temperature dependent current $I_{NL}$ 450.

In order for the temperature coefficient calibration component 405 to be in a passive state at the reference temperature, such that the output current $I_{OUT}$ 320 of the current generator circuit 320 comprises an unaltered absolute current value at the reference temperature, the temperature coefficient calibration component 405 is arranged such that the temperature dependent current $I_{NL}$ 450 is equal to zero at the reference temperature. In this manner, the temperature dependent current $I_{NL}$ 450 is effectively passive at the reference temperature, and does not force a change in the current flowing through resistance R2 442. To achieve a temperature dependent current $I_{NL}$ 450 equal to zero, the voltage at the further node (B) 454 must equal the voltage at the common point (A) 452.

Since the emitter junctions for both the TC transistor device Q3 460 and the transistor device Q1 430 are both operably coupled to the ground plane 404, when the base-emitter voltage for the TC transistor device Q3 460 ($V_{beQ3}$) is equal to the base-emitter voltage for the base-emitter voltage of the transistor device Q1 430 ($V_{beQ1}$), the voltage at the further node (B) 454 is equal to the voltage at the common point (A) 452, and as such the temperature dependent current $I_{NL}$ 450 is equal to zero.

According to Y. P. Tsividis, "*Accurate Analysis of Temperature Effects in Ic-Vbe Characteristics with Application to Bandgap Reference Sources,*" *IEEE J. Solid-State Circuits, vol. SC*-15, pp. 1076-1084, December 1980, the expression for base-emitter voltage may be written as following:

$$V_{be}(T) = V'_{G0} - \frac{V'_{G0} - V_{beR}}{T_R} \cdot T - V_T \cdot (n - x) \cdot \ln\left(\frac{T}{T_R}\right) \quad \text{[Equation 5]}$$

where:

$V'_{G0}$—bandgap voltage of silicon, extrapolated to 0 degrees Kelvin, $V_{beR}$—base-emitter voltage at temperature TR, $T_R$—reference temperature, ° K;

n—a process dependent, but temperature independent parameter;

x—is a power of temperature dependency of collector current; and $$V_T = \frac{k \cdot T}{q}$$

where "k" is a Boltzmann's constant, "q" is the charge of electron, "T" is an absolute temperature, in degrees of Kelvin.

Based on this above, if the transistor device Q1 430 and the TC transistor device Q3 460 have the same emitter current density at the reference temperature ($T=T_R$), the base-emitter voltage difference may be expressed as below $$V_{beQ1} - V_{beQ3} = V_A - V_B = V_T \cdot (x_{TI} - x_{(Vbe-NL)}) \cdot \ln\left(\frac{T}{T_R}\right) \quad \text{[Equation 6]}$$

Accordingly, since $$\ln\left(\frac{T}{T_R}\right) = 0$$

at the reference temperature $T_R$ (i.e. when $T=T_R$), by arranging the TC transistor device Q3 460 and the transistor device Q1 430 to have the same emitter current density at the reference temperature (i.e. when $T=T_R$) such that Equation 6 above is true, the voltage at the further node (B) 454 will be equal to the voltage at the common point (A) 452 when $T=T_R$, and as such the temperature dependent current $I_{NL}$ 450 will be equal to zero when $T=T_R$. Thus, by arranging the TC transistor device Q3 460 and the transistor device Q1 430 to operate at the same emitter current density at the reference temperature $T=T_R$, a substantially zero thermally dependent current $I_{NL}$ may be achieved. The same emitter current density at the reference temperature $T=T_R$ for TC transistor device Q3 460 and the transistor device Q1 430 may be assured by ensuring an appropriate ratio between their respective collector currents (i.e. between the reference current $I_{TI}$ 110 and the collector current for the TC transistor device Q3 460 $I_{Vbe}$-$I_{NL}$ 465), as well as by ensuring an appropriate M5/M6 temperature coefficient calibration component current mirror ratio, and appropriate emitter areas for the TC transistor device Q3 460 and the transistor device Q1 430. Such appropriate ratios etc. may be achieved through appropriate component sizing.

From Equation 6 above, the analytical expression for the temperature dependent current $I_{NL}$ 450 is given below:

$$I_{NL} = \frac{V_T}{R5 + Rtc\langle 1\rangle + Rtc\langle 0\rangle} \cdot (x_{Tl} - x_{(Vbe-NL)}) \cdot \ln\left(\frac{T}{T_R}\right) \quad \text{[Equation 7]}$$

As can be seen from Equation 7, the temperature dependent current $I_{NL}$ 450 is a product of linear and non-linear (logarithmic) terms. The logarithmic term goes to zero at $T=T_R$, which fact is used to create a cross-point where the absolute value of the output current $I_{OUT}$ 320 is not impacted by temperature coefficient calibration. The linear term may be used for temperature coefficient calibration, and does not impact the location of cross-point reference temperature.

In the illustrated example, the temperature coefficient calibration component 405 further comprises a further transistor device M7 480 operably coupled to the base terminal of the TC transistor device Q3 460, and arranged to provide drive to the base terminal of the TC transistor device Q3 460 such that the collector current of the TC transistor device Q3 460 is equal to the current $I_{Vbe}$-$I_{NL}$ 465 supplied thereto by the second current mirror stage transistor device M5 472. The temperature coefficient calibration component 405 further comprises at least one resistance R4 485 operably coupled between the base terminal of the TC transistor device Q3 460 and the ground plane 404, to provide a non-zero DC current through the transistor device M7 480.

It will be appreciated that the MOS devices M1 420, M2 422, M3 424 and M4 426 may be replaced by BJT devices, in which case second-order effects related to base currents should be considered. Furthermore, in the illustrated example transistor devices Q1 430, Q2 432 and Q3 460 have been implemented using BJT devices because of their exponential $I_c$-$V_{be}$ dependence. According to theory of operation of MOSFET devices, field effect transistors in sub-threshold (or weak inversion) mode operate like BJTs, i.e. $Id(V_{Gs}) \sim \exp(V_{Gs})$. Accordingly, it is contemplated that transistor devices Q1 430, Q2 432 and Q3 460 may be replaced by NMOS devices where they operate in the weak inversion (exponential) mode. '$V_{be}$' referenced terms in analytical expressions would be replaced with ones referenced to '$V_{GS}$' in this case.

Figure 6:
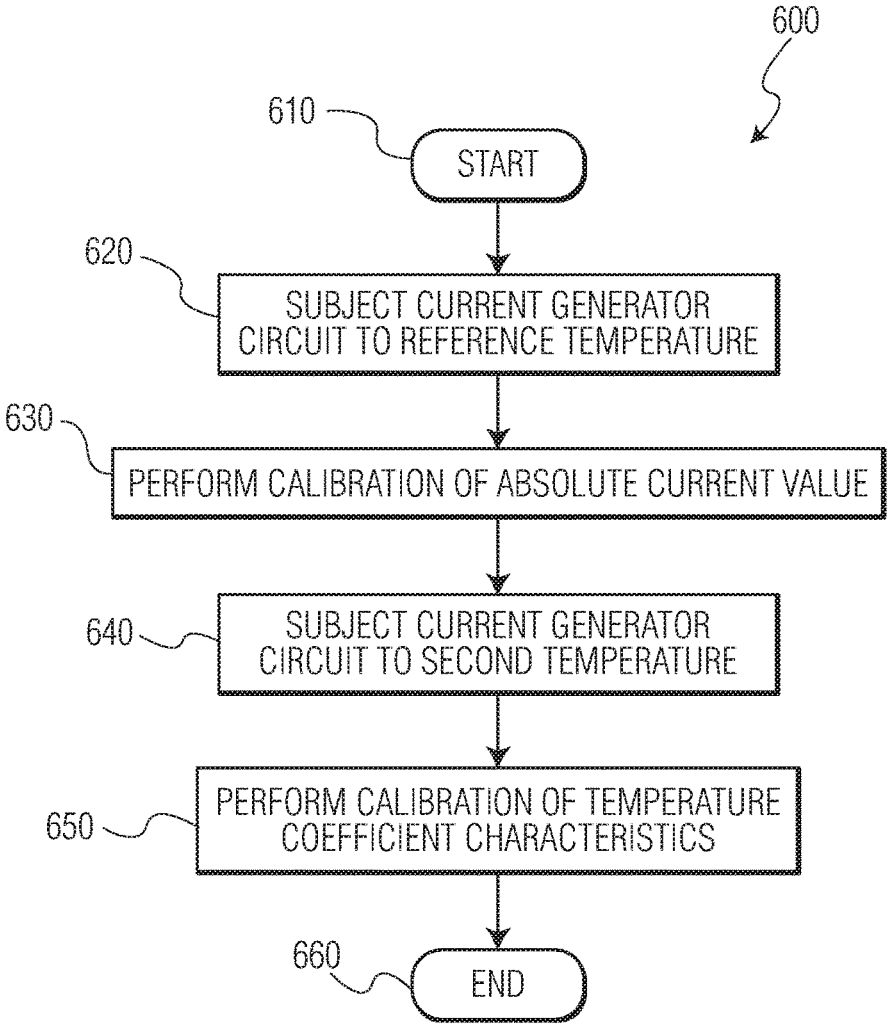
FIG. 6 illustrates a simplified flowchart of an example of a method of calibrating a current generator circuit.

Referring now to FIG. 6, there is illustrated a simplified flowchart 600 of an example of a method of calibrating a current generator circuit, such as the current generator circuit 310 illustrated in FIGS. 3 and 4.

The method starts at 610, and moves on to 620 where the current generator circuit is subjected to a reference temperature. For example, the reference temperature may comprise (near) room temperature, or some other anticipated operational temperature for an IC device comprising the current generator circuit. Next, at 630, calibration of an absolute output current value is performed, whilst the current generator circuit 310 is subjected to the reference temperature. For example, and as illustrated in FIG. 3, a test system 330 may be operably coupled to the current generator circuit and arranged to measure the output current $I_{OUT}$ 320 of the current generator circuit 310. The test system 330 may then perform such calibration of the absolute output current value by way of the configurable resistance component of the absolute current calibration component 444. Advantageously and as previously mentioned, by arranging the temperature coefficient calibration component 405 to be in a passive state at the reference temperature, an absolute current value for the output current $I_{OUT}$ 320 may be accurately calibrated, by way of the absolute current calibration component 444, substantially independently of any temperature coefficient calibration.

The method then moves on to 640, where the current generator circuit 310 is subjected to a second temperature, different to the reference temperature. Next, at 650, calibration of a temperature coefficient characteristic of the output current $I_{OUT}$ 320 of the current generator circuit 310 is performed, whilst the current generator circuit is subjected to the second temperature. For example, the test system 330 illustrated in FIG. 3 may perform such calibration of a temperature coefficient characteristic of the output current $I_{OUT}$ 320 by way of the configurable resistance component 455 of the temperature coefficient calibration component 405. Advantageously and as previously mentioned, by providing a separate component for temperature coefficient calibration, having calibrated the absolute current value at the reference temperature, temperature coefficient calibration may subsequently be performed at a second temperature (at which the temperature coefficient calibration component 405 is not in a passive state), substantially independently of the absolute current value calibration. This is in contrast to the conventional integrated current generator circuit 100 illustrated in FIG. 1, with which it is not possible to calibrate a temperature coefficient characteristic without impacting on the absolute current value for the output current.

Compared to such a convention integrated current generator circuit, the current generator circuit 310 illustrated in FIG. 4 separates temperature coefficient and absolute value calibration at a cross-point reference temperature $T_R$. This enables calibration to be performed as follows:

(i) Measure and calibrate $I_{OUT}$ absolute value at cross-point reference temperature $T_R$ to the targeted value.

(ii) Measure $I_{OUT}$ value at the second temperature (T2) from a range (no need to recall any data stored for previous measurement, just simple calibration to the targeted value using look-ahead).

This new calibration method allows simplification of the calibration procedure with reduced requirements to test equipment and/or smaller die size due to the removal of the need to store data from the initial measurement step. Furthermore, because of the simplification in the individual calibration steps, look-ahead (a simple search through all trim bit combinations to find the best one) is possible, which is a more accurate technique than blind calibration.

Significantly, by not changing the absolute value of the output current $I_{OUT}$ 320 at a given reference temperature makes it possible to have independent temperature coefficient and absolute value calibration on every individual die in mass production.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Although specific conductivity types or polarity of potentials have been described in the examples, it will be appreciated that conductivity types and polarities of potentials may be reversed.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements The mere fact that certain measures are recited in mutually different claims does not indicate that a combination of these measures cannot be used to advantage.

The invention claimed is:

1. A current generator circuit comprising:

at least one current generation component arranged to generate an output current of the current generator circuit;

at least one absolute current calibration component arranged to enable calibration of an absolute current value of the output current; and at least one temperature coefficient calibration component arranged to enable calibration of a temperature coefficient characteristic of the output current, the at least one temperature coefficient calibration component being further arranged to be in a passive state at a reference temperature.

2. The current generator circuit of claim 1, wherein the at least one current generation component comprises at least a first current mirror stage, the at least first current mirror stage comprising a first transistor device and a second transistor device configured in an asymmetric current mirror arrangement whereby the first transistor device is configured as a current-to-voltage converter and the second transistor device is configured as a voltage-to-current converter, and at least a first resistance, is operably coupled between base and emitter terminals of the first transistor device, and at least one further resistance, is operably coupled between the base terminal of the first transistor device and the base terminal of the second transistor device.

3. The current generator circuit of claim 2, wherein the at least one temperature coefficient calibration component is arranged to introduce a temperature dependent current, into a common node between the at least first and at least one further resistances.

4. The current generator circuit of claim 3, wherein the at least one temperature coefficient calibration component is arranged such that the temperature dependent current is equal to zero at the reference temperature.

5. The current generator circuit of claim 4, wherein the at least one temperature coefficient calibration component comprises at least one configurable resistance component operably coupled between the common node between the at least first and at least one further resistances and a further node within the at least one temperature coefficient calibration component, and the at least one temperature coefficient calibration component is arranged to generate a temperature dependent voltage at the further node therein.

6. The current generator circuit of claim 5, wherein the at least one temperature coefficient calibration component is arranged to generate a temperature dependent voltage at the further node therein equal to the voltage at the common node between the at least first and at least one further resistances at the reference temperature.

7. The current generator circuit of claim 6, wherein the at least one temperature coefficient calibration component comprises a temperature coefficient transistor device, a base terminal of which is operably coupled to the further node of the at least one temperature coefficient calibration component; wherein the temperature coefficient transistor device of the at least one temperature coefficient calibration component and the first transistor device of the at least first current mirror stage of the at least one current generation component are arranged to have the same emitter current density at the reference temperature.

8. The current generator circuit of claim 7, wherein the at least one temperature coefficient calibration component comprises a current mirror stage comprising:

a first current mirror stage transistor device configured as a current-to-voltage converter and arranged to convert a current flowing through the at least one further resistance of the at least one current generation component into a voltage signal; and a second current mirror stage transistor device configured as a voltage-to-current converter and arranged to convert the voltage signal generated by the first current mirror stage transistor device into a collector current for the temperature coefficient transistor device.

9. The current generator circuit of claim 8, wherein:

the first transistor device of the at least first current mirror stage of the at least one current generation component;

the temperature coefficient transistor device of the at least one temperature coefficient calibration component; and the first and second current mirror stage transistor devices of the at least one temperature coefficient calibration component are sized such that the first transistor device of the at least first current mirror stage of the at least one current generation component and the temperature coefficient transistor device of the at least one temperature coefficient calibration component comprise the same emitter current density at the reference temperature.

10. The current generator circuit of claim 8, wherein the at least one temperature coefficient calibration component further comprises at least one further transistor device operably coupled to the base terminal of the temperature coefficient transistor device, and arranged to provide drive to the base terminal of the temperature coefficient transistor device such that the collector current of the temperature coefficient transistor device is equal to the current supplied thereto by the second current mirror stage transistor device.

11. The current generator circuit of claim 10, wherein the at least one temperature coefficient calibration component further comprises at least one resistance operably coupled between a base terminal of the temperature coefficient transistor device and a ground plane.

12. The current generator circuit of claim 2, wherein reverse feedback is provided between the collector and base terminals of the first transistor device of the at least first current mirror stage of the at least one current generation component by way of a feedback transistor device operably coupled between a supply rail and the base terminal of the first transistor device of the at least first current mirror stage of the at least one current generation component, and responsive to the voltage at the collector terminal of the first transistor device of the at least first current mirror stage of the at least one current generation component.

13. The current generator circuit of claim 2, wherein a current flow through the second transistor device of the at least first current mirror stage of the at least one current generation component comprises a reference current on which the output current of the current generator circuit is at least partially based.

14. The current generator circuit of claim 13, wherein the at least one current generation component further comprises at least one further current mirror stage, the at least one further current mirror stage comprising a third transistor device configured as a current-to-voltage converter and arranged to convert the current flowing through the second transistor device of the at least first current mirror stage of the at least one current generation component into a voltage signal.

15. The current generator circuit of claim 14, wherein the at least one further current mirror stage comprises a fourth transistor device configured as a voltage-to-current converter and arranged to convert the voltage signal generated by the third transistor device into a collector current for the first transistor device of the at least first current mirror stage of the at least one current generation component.

16. The current generator circuit of claim 14, wherein the at least one further current mirror stage comprises a fifth transistor device configured as a voltage-to-current converter and arranged to convert the voltage signal generated by the third transistor device into the output current of the current generator circuit.

17. The current generator circuit of claim 2, wherein the at least one absolute current calibration component is operably coupled to an emitter terminal of the second transistor device of the at least first current mirror stage of the at least one current generation component, and arranged to enable a voltage at the emitter terminal of the second transistor device of the at least first current mirror stage to be calibrated.

18. An integrated circuit device comprising at least one current generator circuit according to claim 1.

19. A method of calibrating a current generator circuit having at least one current generation component arranged to generate an output current, at least one absolute current calibration component arranged to enable calibration of an absolute current value of the output current, and at least one temperature coefficient calibration component arranged to enable calibration of a temperature coefficient characteristic of the output current, the at least one temperature coefficient calibration component being further arranged to be in a passive state at a reference temperature, the method comprising:

subjecting the current generator circuit to the reference temperature;

performing calibration of an absolute current value of the output current of the current generator circuit, whilst the current generator circuit is subjected to the reference temperature;

subjecting the current generator circuit to a second temperature; and performing calibration of a temperature coefficient characteristic of the output current of the current generator circuit, whilst the current generator circuit is subjected to the second temperature.

* * * * *